US006598950B1

(12) United States Patent
Hosono et al.

(10) Patent No.: US 6,598,950 B1
(45) Date of Patent: Jul. 29, 2003

(54) INK JET RECORDING APPARATUS AND METHOD OF DRIVING INK JET RECORDING HEAD INCORPORATED IN THE SAME

(75) Inventors: Satoru Hosono, Nagano (JP); Kenji Otokita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/983,750

(22) Filed: Oct. 25, 2001

(30) Foreign Application Priority Data

Oct. 25, 2000 (JP) ..... 2000-326067

(51) Int. Cl.[7] ..... B41J 29/38
(52) U.S. Cl. ..... 347/11; 347/10
(58) Field of Search ..... 347/10, 11

(56) References Cited

U.S. PATENT DOCUMENTS 5,512,922 A 4/1996 Paton ..... 347/12
6,312,076 B1 * 11/2001 Taki et al. ..... 347/10

FOREIGN PATENT DOCUMENTS

EP 0927634 A1 7/1999 ..... B41J/2/045
EP 0988974 A2 3/2000 ..... B41J/2/045
EP 1023998 A2 8/2000 ..... B41J/2/045
JP 0 827 838 A2 * 3/1998 ..... B41J/2/21

OTHER PUBLICATIONS

European Search Reports, EP 01 12 4399.
Abstract 01124399.5

* cited by examiner

*Primary Examiner*—Hai Pham
*Assistant Examiner*—Alfred E Dudding
(74) *Attorney, Agent, or Firm*—Sughrue Mion, PLLC

(57) ABSTRACT

A recording head is provided with a pressure chamber communicated with a nozzle orifice from which an ink droplet is ejected, and a vibration plate which constitutes a part of the pressure chamber. A pressure generating element deforms the vibration plate to vary a volume of the pressure chamber. A drive signal generator generates a drive signal for driving the pressure generating element. The pressure generating element is driven such that the pressure chamber is contracted so as to push out a meniscus of ink from the nozzle orifice such an extent that an ink drop is not ejected therefrom. Then the pressure chamber is expanded so as to pull the pushed-out meniscus toward the pressure chamber. Then the pressure chamber is contracted and held in the contracted state to eject an ink droplet from the nozzle orifice.

26 Claims, 8 Drawing Sheets

INK JET RECORDING APPARATUS AND METHOD OF DRIVING INK JET RECORDING HEAD INCORPORATED IN THE SAME

BACKGROUND OF THE INVENTION

The present invention relates to an ink jet recording apparatus capable of ejecting extremely small ink droplets and a method of driving an ink jet recording head incorporated in the apparatus.

An ink jet recording apparatus includes a recording head having a multiplicity of nozzle orifices arranged in a sub-scanning direction (a recording paper feeding direction) and is arranged to attain desired printing result by moving the recording head in a main-scanning direction (a width direction of the recording sheet) by a carriage mechanism to thereby perform predetermined paper feeding. Ink droplets are respectively ejected at predetermined timings from the respective nozzle orifices of the recording head based on dot pattern data which is obtained by converting print data inputted from a host computer. These ink droplets reach and attach to a print recording medium such as a recording sheet to thereby form dot images and complete the printing operation.

The recording head is configured in a manner that the deformation of a piezoelectric vibrator is transmitted to a vibration plate and a pressure chamber is contracted to increase the inner pressure thereof to thereby eject an ink droplet from the nozzle orifice. The piezoelectric vibrator is deformed by changing driving voltage inputted to the piezoelectric vibrator. In general, the piezoelectric vibrator is arranged so as to have larger deformation when higher driving voltage is inputted thereto. Thus, an ink droplet is ejected by applying a drive signal for changing the voltage level of the driving voltage to the piezoelectric vibrator to thereby expand and contract the pressure chamber.

As described above, the ink jet recording apparatus constitutes an image depending on whether ink droplets are ejected or not, that is, depending on the presence or non-presence of dot images. Thus, the ink jet recording apparatus can not print and output half-tone such as a gray image, if the apparatus is as it is.

Thus, there has been employed a method in which half-tone is realized by forming a single pixel with plural dots such as 4×4, 8×8 matrix. Although it is possible to perform finer tone reproduction when the pixel resolution is made higher, the substantial resolution rather degrades if the pixel resolution is made higher without changing the diameter of each recording dot. On the other hand, if each dot diameter is large, the graininess in a highlight image becomes remarkable. Thus, in order to perform tone reproduction with a high resolution, it is required to make the volume of an ink droplet as small as possible to thereby make the diameter of a recording dot small.

FIG. 7 shows a related drive signal for ejecting a fine ink droplet. This example of the signal is employed in such a type of recording head that a piezoelectric vibrator changes in a direction for expanding a pressure chamber when a driving voltage rises, while the piezoelectric vibrator changes in a direction for contracting the pressure chamber when the driving voltage lowers.

In a standby state P0 of the aforesaid drive signal, as shown in FIG. 8A, a meniscus 50 stops at a nozzle orifice 28. When a signal (P1) for rising the voltage from the minimum driving voltage VL in the standby state P0 to a maximum driving voltage VH1, the pressure chamber expands so that the meniscus 50 is pulled toward the pressure chamber from the nozzle orifice 28 as shown in FIG. 8B. Then, after holding the maximum driving voltage VH1 for a predetermined time period (P2), a signal (P3) for rapidly lowering the voltage to a voltage VH2 which is almost the middle between VL and VH1 is inputted, and the voltage VH2 is held for a predetermined time period (P4). At this time, the pressure chamber in the expanded state contracts to increase the pressure therein, whereby ink in the vicinity of the center of the meniscus 50 thus pulled is ejected and jetted as an ink droplet as shown in FIG. 8C. Thereafter, a signal (P5) for lowering the voltage to the minimum driving voltage VL same as that of the standby state at a relatively slow speed not ejecting an ink droplet is inputted, whereby the meniscus 50 is returned to the position of the nozzle orifice 28 as shown in FIG. 8D while the residual vibration thereof is damped.

In the recording apparatus using the drive signal, the pressure within the pressure chamber is increased in the state where the meniscus 50 is once pulled to a large extent within the chamber thereby to eject the ink in the vicinity of the center of the meniscus 50 thus pulled as an ink droplet. Thus, an ink droplet relatively small as compared with the diameter of the nozzle orifice 28 can be ejected.

Recently, in order to further improve the resolution, there has been desired a recording apparatus capable of ejecting a further fine ink droplet. However, in the aforesaid related recording apparatus, the reduction of the diameter of an ink droplet to be ejected is limited. It is considered to make an ink droplet to be ejected fine by reducing the diameter of the nozzle orifice 28. However, if the diameter of the nozzle orifice 28 is reduced, it becomes difficult to process the nozzle orifice 28, so that the cost of the apparatus rises and the accuracy of the apparatus likely degrades. Further, there arises a problem that the clogging may be severe that is caused when the ink in the vicinity of the nozzle orifice 28 dries during the suspension or the like of the apparatus and the recovery from the clogging is difficult. Thus, such a proposal can not be actually realized.

SUMMARY OF THE INVENTION

The invention has been made in view of the aforesaid circumstance of the prior art, and an object of the invention is to provide an ink jet recording apparatus and a method of driving an ink jet recording head incorporated in the apparatus, capable of ejecting extremely small ink droplets without reducing the diameter of a nozzle.

In order to achieve the above object, according to the present invention, there is provided an ink jet recording apparatus, comprising:

- a recording head, provided with a pressure chamber communicated with a nozzle orifice from which an ink droplet is ejected, and a vibration plate which constitutes a part of the pressure chamber;
- a pressure generating element, which deforms the vibration plate to vary a volume of the pressure chamber, and
- a drive signal generator, which generates a drive signal for driving the pressure generating element, the drive signal including;
  - a first waveform component, which drives the pressure generating element so as to contract the pressure chamber, to push out a meniscus of ink from the nozzle orifice such an extent that an ink drop is not ejected therefrom;
  - a second waveform component, which follows the first waveform component and drives the pressure generating element so as to expand the pressure chamber to a first volume, to pull the meniscus toward the pressure chamber;

a third waveform component, which follows the second waveform component and drives the pressure generating element so as to contract the pressure chamber from the first volume to a second volume which is larger than an initial volume of the pressure chamber, and hold the contracted state to eject an ink droplet from the nozzle orifice; and a fourth waveform component which follows the third waveform component and drives the pressure generating element so as to contract the pressure chamber such an extent that an ink droplet is not ejected from the nozzle orifice.

In this configuration, since the meniscus is once pushed out and then pulled toward the pressure chamber, a portion in the vicinity of the center of the meniscus is locally pulled by the second waveform component. Since the third waveform component is inputted in this state thereby to contract the pressure chamber, the ink at an extremely small area in the substantial center of the meniscus moves to the nozzle orifice and is ejected therefrom as an ink droplet. Thus, an extremely small ink droplet can be ejected without reducing the diameter of the nozzle orifice and so the printing with a high resolution can be realized. Further, the speed of the ink droplets being ejected rises and the accuracy of the impact points of the ink droplets can be improved.

Preferably, a potential of an initial end of the first waveform component is higher than a lowest potential of the drive signal, and has a positive value.

In this configuration, the lowest potential can be set at the ground potential so that the control is made easier.

Preferably, a potential of a termination end of the fourth waveform component and a potential of an initial end of the second waveform component are identical.

In this configuration, the residual vibration of the meniscus due to the ink ejection can be damped sufficiently. Thus, at the time of ejecting ink droplets in series, the next ejecting operation can be performed after sufficiently damping the residual vibration of the meniscus, so that the degree of the variation of the volumes of the ink droplets can be made small and so stable printing quality can be secured.

Here, it is preferable that the drive signal includes a fifth waveform component which follows the fourth waveform component and restores a potential of a termination end of the fourth waveform component to a potential which is identical with the initial end potential of the first waveform component.

In this configuration, it is not necessary to add an unnecessary signal for restoring the voltage at the time of generating the drive signals in series.

Preferably, a time period from an initial end of the first waveform component to an initial end of the second waveform component is identical with a time period obtained by multiplying a natural vibration period of the pressure chamber by an integer.

In this configuration, the generation of crosstalk can be suppressed so that ink droplets can be ejected more stably.

Alternatively, a time period from an initial end of the first waveform component to an initial end of the second waveform component is identical with a time period obtained by multiplying a natural vibration period of the vibration plate by an integer.

Also in this configuration, the generation of crosstalk can be suppressed so that ink droplets can be ejected more stably.

Preferably, a time period from a termination end of the fourth waveform component to a termination end of the fifth waveform component is identical with a time period obtained by multiplying a natural vibration period of the pressure chamber by an integer.

In this configuration, since a timing where the pressure chamber expands due to the fifth waveform component becomes almost opposite in the phase with respect to the residual vibration of a meniscus, the residual vibration of the meniscus can be damped more effectively. Thus, at the time of ejecting ink droplets in series, the next ejecting operation can be performed after sufficiently damping the residual vibration of the meniscus, so that the degree of the variation of the volumes of the ink droplets can be made small and so stable printing quality can be secured.

Preferably, a potential gradient of the first waveform component is variable in accordance with an environmental condition of the recording apparatus.

The viscosity of the ink or the like changes depending on the environmental condition such as temperature and humidity or the like in the periphery of the apparatus. In this configuration, even if the characteristics of the ink changes, a fine ink droplet can be ejected stably by optimally changing the potential gradient of the first waveform component in accordance with the environmental condition in the periphery of the apparatus. Incidentally, in the invention, "environmental condition" refers to at least one of as temperature and humidity, for example, but not limited thereto.

Preferably, a potential difference between an initial end and a termination end of the first waveform component is 10% to 50% of a potential difference between an initial end and a termination end of the second waveform component.

In this configuration, sufficient ejecting speed of an ink droplet and stability thereof can be secured.

Preferably, the drive signal generator repetitively generates the drive signal at a predetermined times within a unit printing period.

In this configuration, the variable range of the diameter of a dot image is enlarged so that the multi-tone reproduction can be surely realized.

Here, it is preferable that at least one of the drive signals are selectively applied to the pressure generating element to form a single ink dot by at least one ink droplet.

In this configuration, since a plurality of different sizes of dot images are formed based on combination of a plurality of ink droplets, dot images with different sizes can be formed by using the one kind of the drive signal, so that the variable range of the diameter of a dot image is enlarged so that the multi-tone reproduction can be surely realized.

Preferably, the pressure generating element is an electromechanical transducer such as a plezoelectric vibrator.

According to the present invention, there is also provided a method of driving an ink jet recording head provided with a pressure chamber communicated with a nozzle orifice from which an ink droplet is ejected, and a vibration plate which constitutes a part of the pressure chamber, comprising the steps of:

a) contracting the pressure chamber from a first volume to a second volume so as to push out a meniscus of ink from the nozzle orifice such an extent that an ink drop is not ejected therefrom, and holding the contracted state;

b) expanding the pressure chamber from the second volume to a third volume so as to pull the pushed-out meniscus toward the pressure chamber;

c) contracting the pressure chamber from the third volume to a fourth volume, and holding the contracted state to eject an ink droplet from the nozzle orifice; and d) contracting the pressure chamber from the fourth volume to a fifth volume such an extent that an ink droplet is not ejected from the nozzle orifice.

Preferably, the second volume and the fifth volume are identical.

Preferably, the driving further comprises the step of e) expanding the pressure chamber from the fifth volume to the first volume.

Here, it is preferable that the method further comprises the step of determining how many times the steps a)–e) are repeated within a unit printing period.

Further, it is preferable that the repeated number is determined in accordance with a size of ink dot to be formed.

Preferably, a duration of the step a) is identical with a time period obtained by multiplying a natural vibration period of the pressure chamber by an integer.

Alternatively, a duration of the step a) is identical with a time period obtained by multiplying a natural vibration period of the vibration plate by an integer.

Preferably, a duration of the step e) is identical with a time period obtained by multiplying a natural vibration period of the pressure chamber by an integer.

Preferably, a volume difference between the first volume and the second volume, and a duration of the step a) are determined in accordance with an environmental condition of the recording head.

Preferably, a volume difference between the first volume and the second volume is 10% to 50% of a volume difference between the second volume and the third volume.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
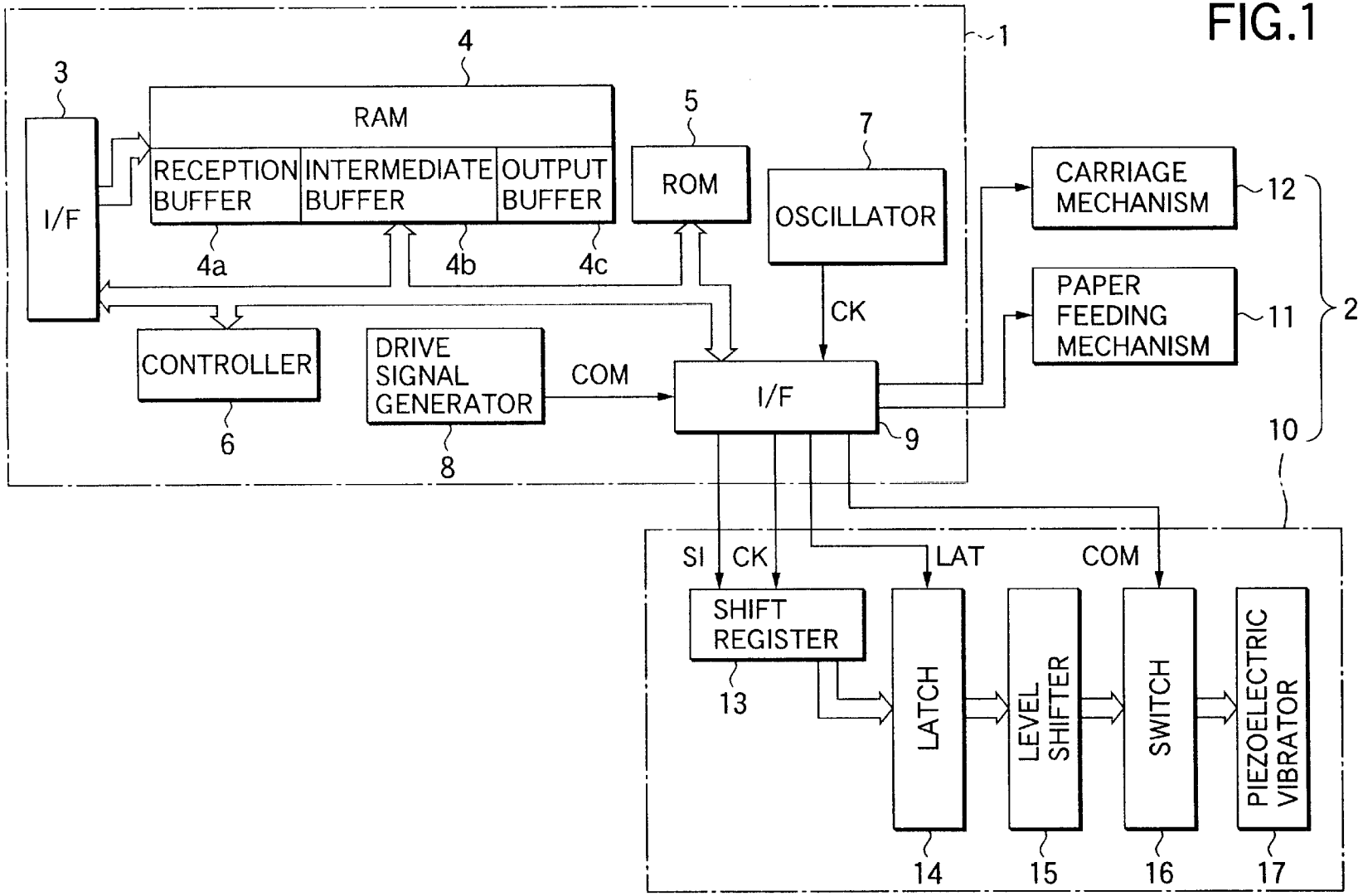
FIG. 1 is an explanatory diagram showing the entire configuration of an ink jet recording apparatus according to a first embodiment of the invention.

First, a first embodiment of the invention will be described with reference to FIGS. 1 to 4D As shown in FIG. 1, a printer serving as an ink jet recording apparatus is configured by a printer controller 1 and a print engine 2. The printer controller 1 includes an interface (hereinafter referred to "I/F") 3 which receives print data or the like supplied from a host computer (not shown) or the like; a RAM 4 which stores various kinds of data; a ROM 5 which stores routines for executing various kinds of data processing; a controller 6 formed by a CPU or the like; an oscillator 7; a drive signal generator 8 for generating a drive signal applied to a recording head 10 described later; and an I/F 9 which transmits dot pattern data (hit map data) converted from print data, the drive signal or the like to the print engine 2.

The I/F 3 receives the print data from the host computer or the like. The print data is formed by one or plural data among character codes, graphic function, image data, for example. The I/F 3 can output a busy signal (BUSY), an acknowledge signal (ACK) or the like to the host computer.

The RAM 4 is utilized as a reception buffer 4*a,* an intermediate buffer 4*b,* an output buffer 4*c,* a work memory (not shown) or the like. The reception buffer 4*a* temporarily stores the print data which is supplied from the host computer and received by the I/F 3. The intermediate buffer 4*b* stores intermediate code data that is obtained by converting the print data into intermediate code by the controller 6. The dot pattern data obtained by decoding the intermediate code data (tone data) is loaded in the output buffer 4*c*. The ROM 5 stores various kinds of control routines executed by the controller 6, font data, graphic functions, various kinds of procedures or the like.

The controller 6 reads the print data from the reception buffer 4*a,* then converts the print data into the intermediate code and stores the intermediate code data into the intermediate buffer 4*b*. Then, the controller 6 analyzes the intermediate data read from the intermediate buffer 4*b* and converts the intermediate data into the dot pattern data with reference to the font data, the graphic functions or the like within the ROM 5. The dot pattern data thus converted is subjected to the necessary processing and stored in the output buffer 4*c*.

When the dot pattern data corresponding to one line of the recording head 10 is obtained, the dot pattern data corresponding to one line is serially transmitted to the recording head 10 through the I/F 9. When the dot pattern data corresponding to one line is outputted from the output buffer 4*c,* the contents of the output buffer 4*c* is erased and the conversion of the next intermediate data is performed.

The print engine 2 includes the recording head 10, a paper feeding mechanism 11 and a carriage mechanism 12. The paper feeding mechanism 11 is configured by a paper feeding motor, a paper feeding roller or the like and serves to sequentially send recording media such as recoding sheets or the like thereby to perform sub-scanning. The carriage mechanism 12 is configured by a carriage for mounting the recording head 10, a carriage motor or the like for running the carriage by a timing belt or the like and serves to perform main-scanning of the recording head 10.

The recording head 10 has a multiplicity of (for example, 96 or the like) nozzle orifices arranged in a sub-scanning direction to eject ink droplets from the respective nozzle orifices at predetermined timings. The print data developed in the dot pattern data is serially transmitted from the I/F 9 to a shift register 13 in synchronism with a clock signal (CK) supplied from the oscillator 7. The print data (SI) thus transmitted serially is once latched by a latch 14. The print data thus latched is boosted to a predetermined voltage capable of driving a switcher 16, that is, about several ten volts, for example, by a level shifter 15 serving as a voltage amplifier. The print data thus boosted to the predetermined voltage is applied to the switcher 16. The drive signal (COM) from the drive signal generator 8 is applied to the input side of the switcher 16 and a piezoelectric vibrator 17 is coupled to the output side of the switcher 16.

The print data controls the operation of the switcher 16. For example, during the period where the print data applied to the switcher 16 is "1", the drive signal is inputted to the piezoelectric vibrator 17, so that the piezoelectric vibrator 17 performs expansion and contraction deformation in accordance with the drive signal. On the other hand, during the period where the print data applied to the switcher 16 is "0", the drive signal applied to the piezoelectric vibrator 17 is cut off, so that the piezoelectric vibrator 17 holds a potential level charged immediately before the cut-off of the drive signal thereby to hold a deformed state immediately before the cut-off of the drive signal.

The recording head 10 will be explained in detail.

Figure 2:
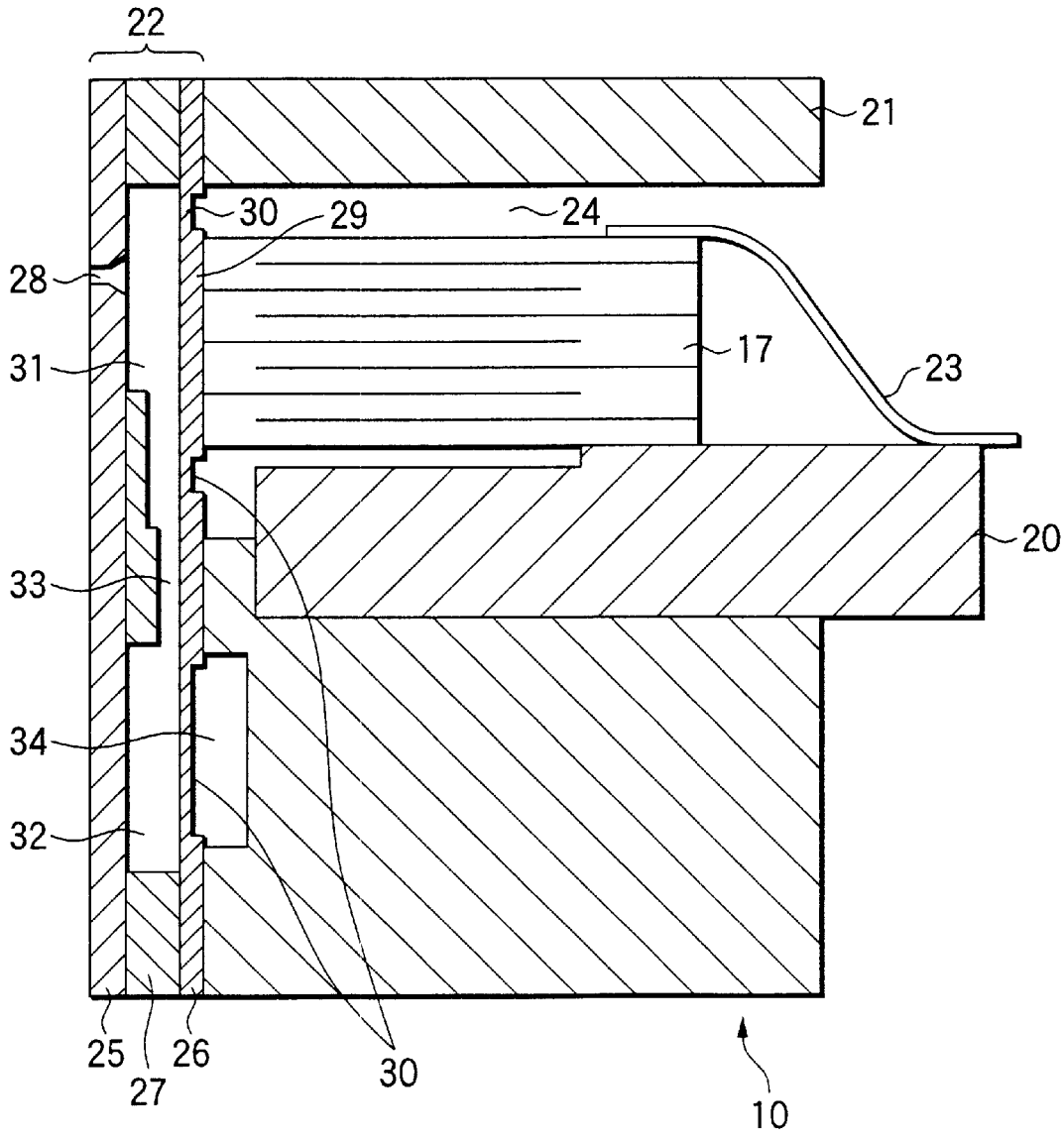
FIG. 2 is an explanatory diagram showing the mechanical structure of a recording head.

The recording head 10 attached with the piezoelectric vibrator 17 of a longitudinal oscillation mode, for example, is used in the aforesaid recording head 10. As shown in FIG. 2, the recording head 10 is provided with a casing 21 made of composite resin and a channel unit 22 pasted to the front face (the left side in the figure). The channel unit 22 is configured by a nozzle plate 25 at which nozzle orifices 28 are perforated, a vibration plate 26 and a channel forming plate 27.

The casing 21 is a block shaped member which is provided with a housing space 24 opened at the front face and the rear face thereof. The piezoelectric vibrator 17 fixed on the fixation base 20 is housed within the housing space 24.

The nozzle plate 25 is a thin plate-shaped member at which a multiplicity of nozzle orifices 28 are perforated along the sub-scanning direction. The respective nozzle orifices 28 are provided with predetermined intervals corresponding to dot forming density (resolution). The vibration plate 26 is a plate-shaped member provided with an island portion 29 on which the piezoelectric vibrator 17 abuts and a thinned portion 30 having elasticity provided so as to surround the periphery of the island portion 29. A multiplicity of the island portions 29 are provided with predetermined intervals in a manner that the one island portion 29 corresponds to the one nozzle orifice 28.

The channel forming plate 27 is provided with hollowed spaces for forming a pressure chamber 31, an ink reservoir 32 and an ink supply port 33 for communicating the pressure chamber 31 with the ink reservoir 32. The nozzle plate 25 is disposed at the front face side of the channel forming plate 27 and the vibration plate 26 is disposed at the rear face side of the channel forming plate 27. The nozzle plate 25 and the vibration plate 26 are integrated by adhesive agent or the like in a state of sandwiching the channel forming plate 27 therebetween thereby to form the channel unit 22.

In the channel unit 22, the pressure chamber 31 is formed at the rear face side of the nozzle orifice 28 and the island portion 29 of the vibration plate 26 is positioned at the rear face side of the pressure chamber 31. The pressure chamber 31 and the ink reservoir 32 are communicated through the ink supply port 33.

The tip end of the piezoelectric vibrator 17 abuts against the island portion 29 from the rear face side thereof and the plezoelectric vibrator 17 is fixed to the casing 21 in this abutting state. The drive signal (COM), the print data (SI) or the like are supplied to the piezoelectric vibrator 17 through a flexible cable 23.

The piezoelectric vibrator 17 is arranged to contract when being charged and expand when being discharged. Thus, in the recording head 10, the piezoelectric vibrator 17 contracts when being charged, whereby the island portion 29 is pulled back in accordance with the contraction action, so that the pressure chamber 31 is expanded. The ink within the ink reservoir 32 flows into the pressure chamber 31 through the ink supply port 33 in accordance with the expansion. On the other hand, the piezoelectric vibrator 17 expands when being discharged, so that the island portion 29 of the elastic plate is pushed thereby to contract the pressure chamber 31. The pressure of the ink within the pressure chamber 31 increases in accordance with the contraction action, whereby an ink droplet is ejected from the nozzle orifice 28. At this time, although the pressure is also transmitted to the ink supply port 33 side, the pressure is absorbed by a damper space 34 through the thinned portion 30 opposing to the ink reservoir 32, so that the pressure can be prevented from being transmitted to the adjacent pressure chamber 31.

The control method of the recording head 10 will be explained.

Figure 3:
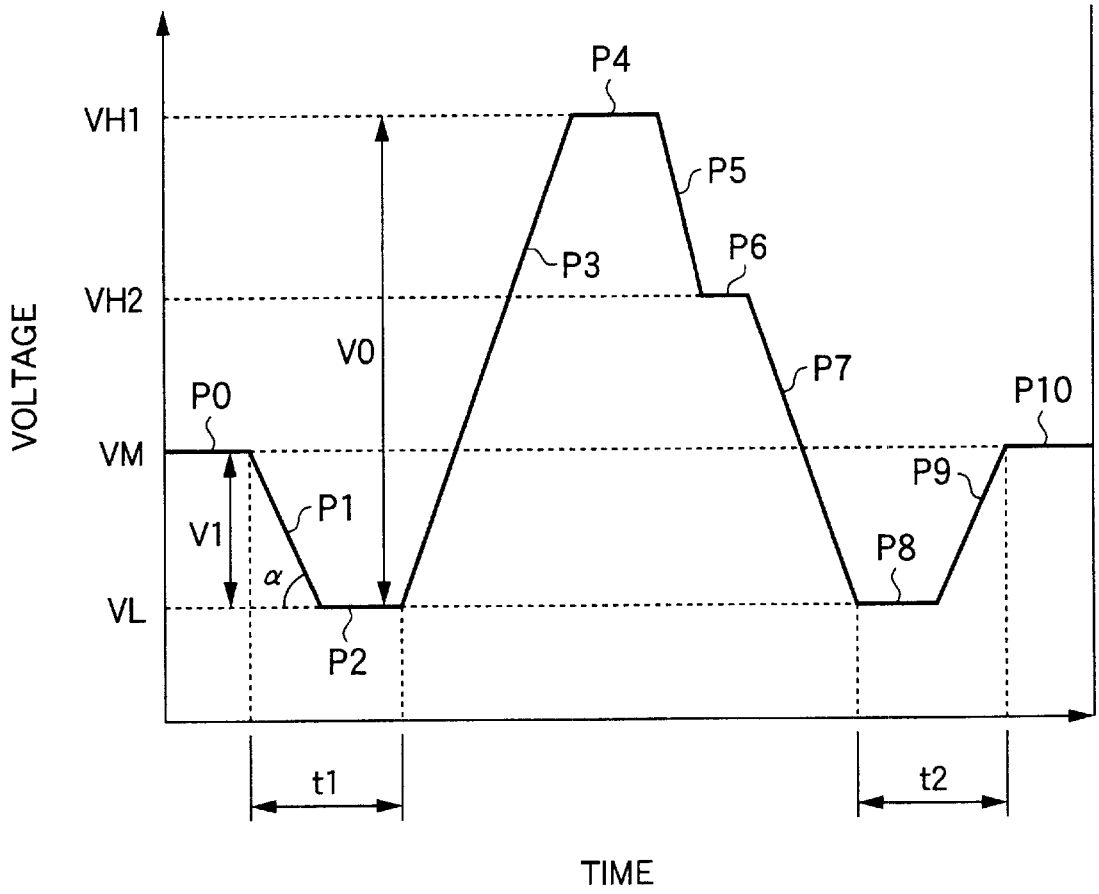
FIG. 3 is an explanatory diagram showing a drive signal used in the first embodiment of the invention.

FIG. 3 is a diagram showing the drive signal generated by the drive signal generator 8. The drive signal is configured in a manner that each of the standby state P0 of a signal initial end and the termination end (P10) of the signal is set to an intermediate driving voltage VM and the waveform of the drive signal is formed between a minimum driving voltage VL and a maximum driving voltage VH1.

The drive signal is provided with: a preparation waveform component P3, P4 in which voltage is raised from the minimum driving voltage VL to the maximum driving voltage VH1 to expand the pressure chamber 31 and maintain the maximum driving voltage VH1 to hold the expanded state of the pressure chamber 31 for a predetermined time period to pull a meniscus toward the pressure chamber; an ejection waveform component P5, P6 in which voltage is lowered to a voltage VH2 almost at the middle between the minimum driving voltage VL and the maximum driving voltage VH1 to contract the pressure chamber 31 and maintain the voltage VH2 for a predetermined time period to hold the contracted state of the pressure chamber 31 thereby to eject an ink droplet; and a damping waveform component P7 in which voltage is lowered slowly to the minimum driving voltage VL to contract the pressure chamber 31 after the ink ejection, thereby to damp the residual vibration of the meniscus. The meniscus means a curved free surface of the ink exposed at the nozzle orifice 28.

The drive signal further has a contraction waveform component P1, P2 in which voltage is lowered from the intermediate driving voltage VM to the minimum driving voltage VL before outputting the preparation waveform component P3, P4 to temporarily contract the pressure chamber 31 thereby to push out the meniscus and maintain this state for a predetermined time period. Further, the drive signal has a restoration waveform component P8, P9 in which holds the minimum driving voltage VL for a predetermined time period after outputting the damping waveform component P7 and restore the voltage again to the intermediate driving voltage VM thereby to restore the volume of the pressure chamber 31 to an original state.

Figure 4A:
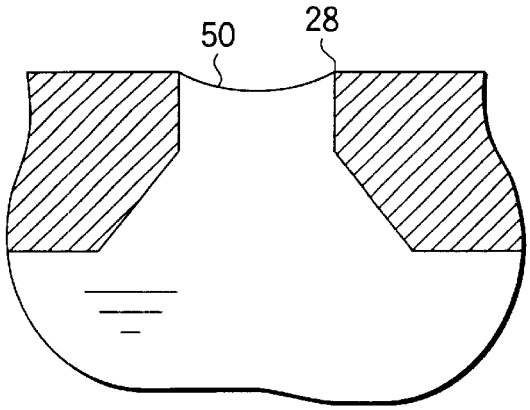
FIGS. 4A to 4D are explanatory diagrams showing the behavior of a meniscus according to the driving method of the invention.
Figure 4B:
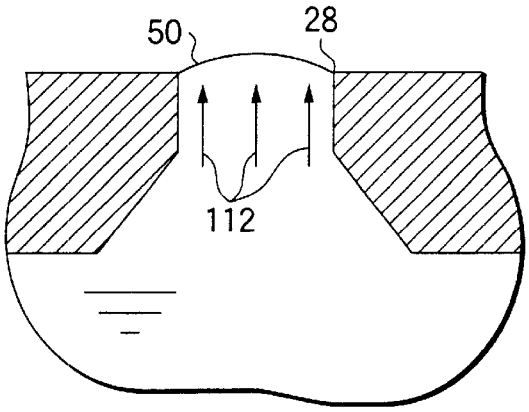

When the drive signal is inputted to the piezoelectric vibrator 17 to expand and contract the piezoelectric vibrator 17, the pressure chamber 31 is also expanded and contracted to eject an ink droplet. That is, at first, in the standby state P0, the meniscus 50 stays at the opening edge of the nozzle orifice 28 as shown in FIG. 4A. When the contraction waveform component P1, P2 is inputted in the standby state P0, the piezoelectric vibrator 17 expands to contract the pressure chamber 31, so that the meniscus 50 is pushed out slightly from the nozzle orifice 28 (such an extent that an ink droplet is not ejected therefrom) in a direction shown by an arrow 112 as shown in FIG. 4B.

Figure 4C:
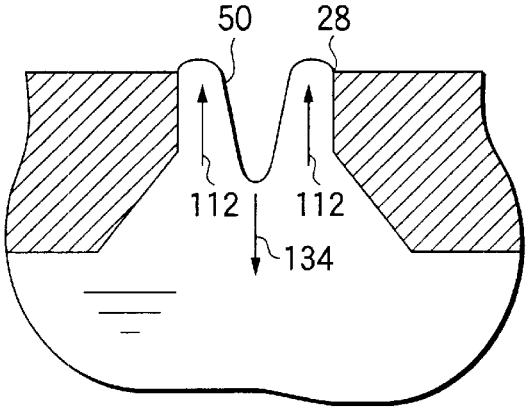
Figure 4D:
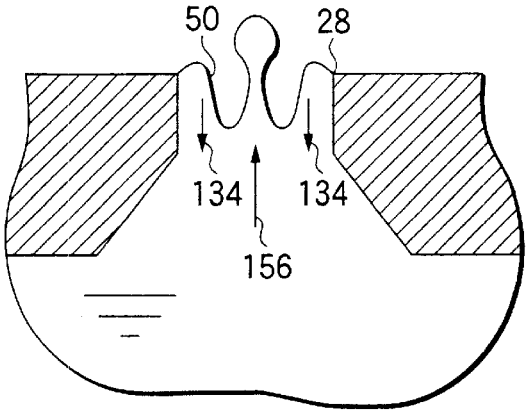

Then, when the preparation waveform component P3, P4 is inputted, the piezoelectric vibrator 17 contracts to expand the pressure chamber 31 thereby to pull the meniscus 50 toward the pressure chamber 31. At this time, since the meniscus 50 being pushed out by the contraction waveform component P1, P2 is pulled, a portion in the vicinity of the center of the meniscus 50 is locally pulled in a direction shown by an arrow 134 as shown in FIG. 4C. At this time, the pressure in the direction shown by the arrow 112 sill remains in the vicinity of the opening edge of the nozzle orifice 28. Then, when the ejection waveform component P5, P6 is inputted, the piezoelectric vibrator 17 expands to contract the pressure chamber 31 rapidly. The pressure within the pressure chamber 31 is increased due to the contraction of the pressure chamber 31, whereby the ink at a fine area in the substantial center of the meniscus 50 moves in a direction shown by an arrow 156 as shown in FIG. 4D and is ejected as an ink droplet. In this case, an ink droplet extremely small as compared with the diameter of the nozzle orifice 28 can be ejected at a high speed.

Then, when the damping waveform component P7 is inputted, the piezoelectric vibrator 17 further extends and the pressure chamber 31 contracts at a relatively slow speed insufficient for ejecting an ink droplet to the extent that the volume of the chamber becomes a value before the inputting of the preparation waveform component, during which the residual vibration of the meniscus 50 is damped. Thereafter, when the restoration waveform component P8, P9 is inputted, the piezoelectric vibrator 17 contracts and the pressure chamber 31 expands to the extent that the volume thereof becomes a value equal to the standby state P0.

In the drive signal, an elapsed time period t1 from the start end of the contraction waveform component P1, P2 to the start end of the preparation waveform component P3, P4 is preferably set to be equal to n-times as large as a natural vibration period Tc of the pressure chamber 31 or n-times as large as a natural vibration period Ta of the vibration plate (here, n is an integer). Thus, the ink can be ejected more stably.

In the drive signal, an elapsed time period t2 from the termination end of the damping waveform component P7 to the termination end of the restoration waveform component P8, P9 is preferably set to be equal to n-times as large as the natural vibration period Tc of the pressure chamber 31 (here, n is an integer). Thus, since a timing where the pressure chamber 31 expands due to the output of the restoration waveform component P8, P9 becomes almost opposite in the phase with respect to the residual vibration of the meniscus 50, the residual vibration of the meniscus 50 can be damped more effectively.

Further, in the drive signal, the voltage difference V1 between the intermediate driving voltage VM and the minimum driving voltage VL of the contraction waveform component P1 is preferably set in a range between 10% or more and 50% or less of the voltage difference V0 of the preparation waveform component P3. This is because when the ratio of the V1 with respect to the voltage difference V0 is smaller than 10%, the ejecting speed of an ink droplet lowers and there arises such a disadvantage that impact points of the ink droplets varies more largely. In contrast, when the ratio exceeds 50%, the stability of the ejecting characteristics degrades on the contrary.

Furthermore, the recording apparatus is preferably provided with a temperature and humidity sensor or a hydrothermograph sensor or the like for measuring an environmental condition such as temperature and humidity in the periphery of the apparatus thereby to change a gradient $\alpha$ of the voltage change in the contraction waveform component P1 in accordance with the environmental condition in the periphery of the apparatus. For example, the viscosity characteristics of the ink or the like changes depending on temperature and humidity or the like in the periphery of the apparatus such that the viscosity of the ink rises in the low temperature environment rather than the high temperature environment and so the behavior of the meniscus 50 also changes. In the recording apparatus, as described above, a fine ink droplet can be ejected in a manner that the meniscus 50 is once slightly pushed out from the nozzle orifice 28 and pulled therein to thereby eject an ink droplet. Thus, a fine ink droplet can be ejected stably by changing the gradient $\alpha$ of the voltage change in the contraction waveform component P1 in accordance with the environmental condition in the periphery of the apparatus.

To be concrete, for example, since the viscosity of the ink lowers and the meniscus 50 is apt to move in the environment of high temperature, the gradient $\alpha$ is set to be small. In contrast, since the viscosity of the ink rises and the meniscus 50 becomes difficult to move in the environment of low temperature, the gradient $\alpha$ is set to be large.

In this manner, according to the embodiment, an extremely small ink droplet can be ejected without making the diameter of the nozzle orifice 28 small and so the printing with a high resolution can be realized. Further, in the embodiment, since the voltage for starting the outputting of the contraction waveform component P1 is the intermediate driving voltage VM, the minimum driving voltage VL can be set at the ground voltage thereby to perform the control easily.

In the damping waveform component P7, when the voltage is changed to the minimum driving voltage VL before the outputting of the preparation waveform component P3, the pressure chamber 31 after ejecting an ink droplet can be contracted sufficiently and so the residual vibration of the meniscus 50 can be damped. Further, when the elapsed time period t2 from the termination end of the damping waveform component P7 to the termination end of the restoration waveform component P8, P9 is set to be equal to n-times as large as the natural vibration period Tc of the pressure chamber 31 (n is an integer), the timing where the pressure chamber 31 expands due to the restoration waveform component P8, P9 becomes almost opposite in the phase with respect to the residual vibration of the meniscus 50, whereby the residual vibration of the meniscus 50 can be damped more effectively. Thus, at the time of ejecting ink droplets continuously, the next ejecting operation can be performed after sufficiently damping the vibration of the meniscus, so that the degree of the variation of the volumes of the ink droplets can be made small and so stable printing quality can be secured.

Figure 5:
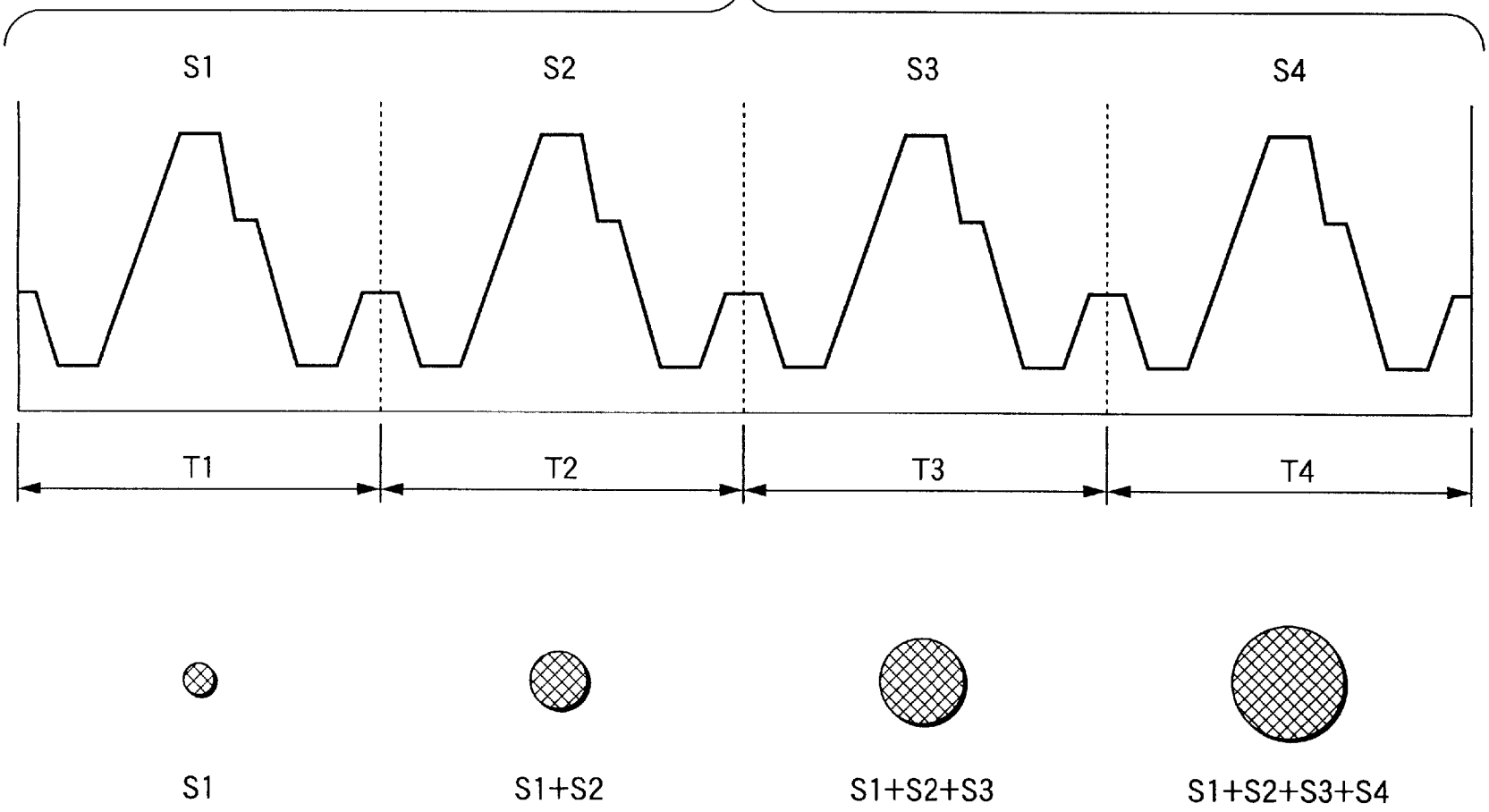
FIG. 5 is an explanatory diagram showing a drive signal according to a second embodiment of the invention, and dot images formed by the drive signal.

FIG. 5 is a diagram showing a drive signal according to a second embodiment of the invention, and dot images formed by such a drive signal. This embodiment is arranged to continuously generate four drive signals each being one shown in FIG. 3. Further, the embodiment is arranged in a manner that the four driving waveforms S1 to S4 are selectively applied to serially eject ink droplets so that one dot image is formed by at least one ink droplet.

At this time, since the restoration waveform component P8, P9 for restoring the voltage to the intermediate driving voltage VM after outputting the damping waveform component P7 is provided, the voltages at the initial end and the termination end of the drive signal are made equal, whereby it is not necessary to add an unnecessary signal for restoring the voltage at the time of generating the drive signals continuously.

In this recording apparatus, for example, in the case of ejecting a single ink droplet to form a fine dot image, the switcher 16 is made in a connection state only during a period T1 to generate only the drive signal S1 thereby to form an dot image from a single ink droplet. In the case of ejecting two ink droplets to form a dot image, the switcher 16 is made in the connection state during the periods T1 and T2 to generate the drive signals S1 and S2 thereby to form an dot image from two ink droplets. In the case of ejecting three ink droplets to form a dot image, the switcher 16 is made in the connection state during the periods T1, T2 and T3 to generate the drive signals S1, S2 and S3 thereby to form an dot image from three ink droplets. In the case of ejecting four ink droplets to form a dot image, the switcher 16 is made in the connection state during the periods T1, T2, T3 and T4 to generate the drive signals S1, S2, S3 and S4 thereby to form an dot image from four ink droplets.

According to such an arrangement, four dot images with different sizes can be formed as shown in FIG. 5 by using the one kind of the drive signal, so that the variable range of the diameter of a dot image becomes large and so the multi-tone reproduction can be realized. The feature of this embodiment other than the aforesaid arrangement is same as the aforesaid embodiment and this embodiment can attain the function and effects similar to those of the aforesaid embodiment.

Figure 6:
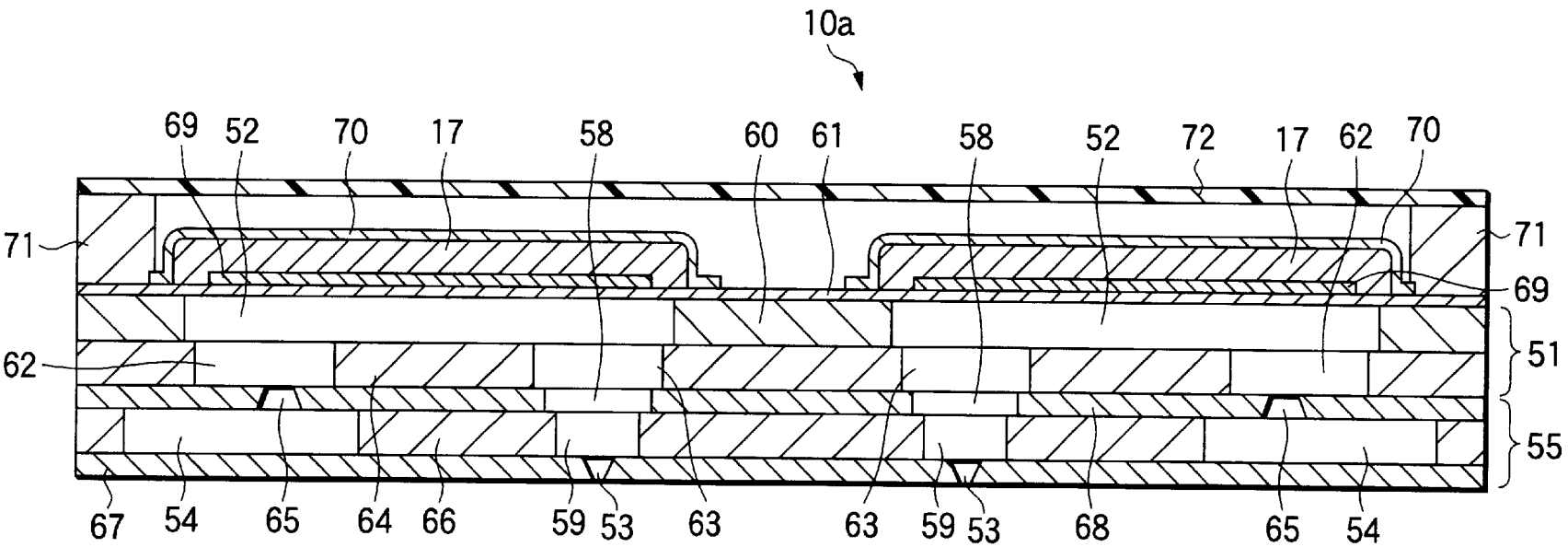
FIG. 6 is a sectional view showing a recording head according to a third embodiment of the invention.
Figure 7:
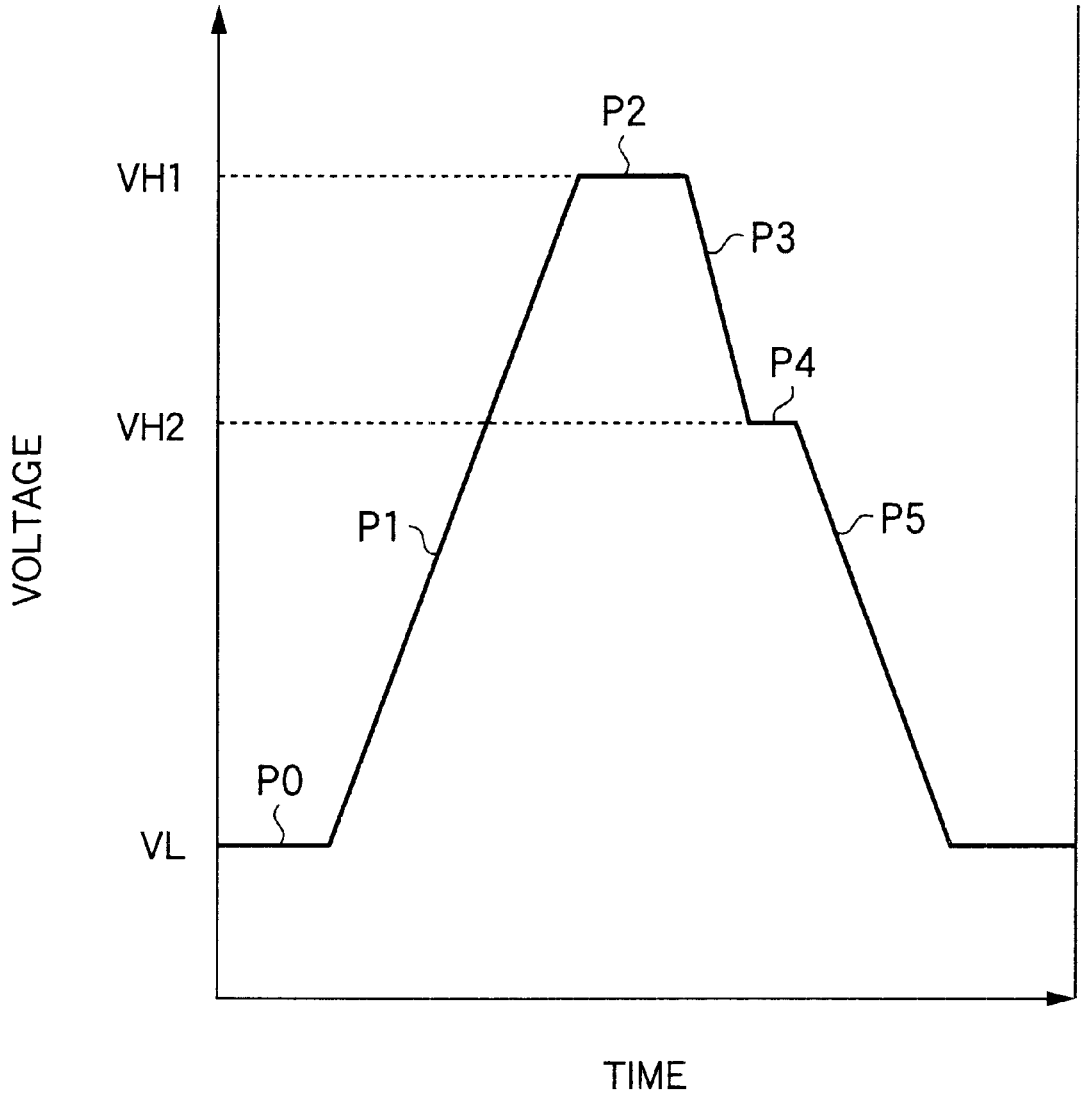
FIG. 7 is a diagram showing a related drive signal.
Figure 8A:
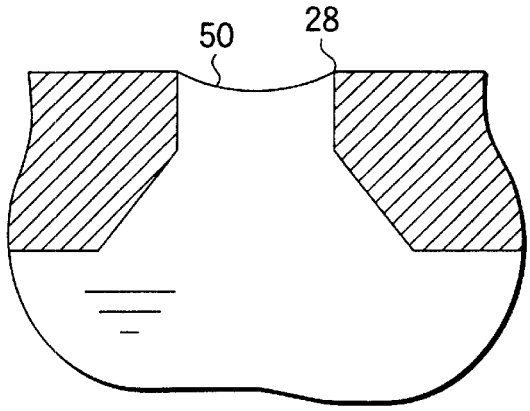
FIGS. 8A to 8D are explanatory diagrams showing the behavior of a meniscus according to the related drive signal.
Figure 8B:
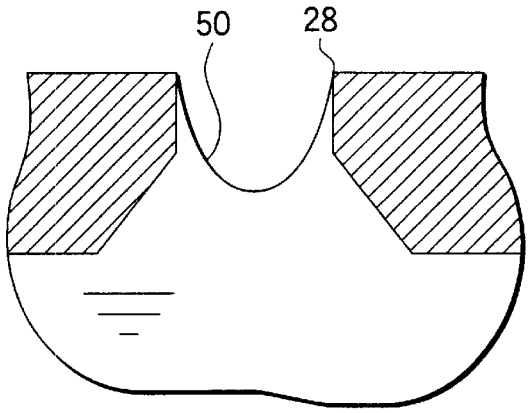
Figure 8C:
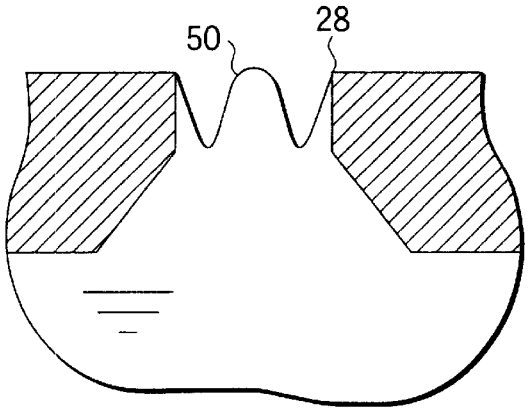
Figure 8D:
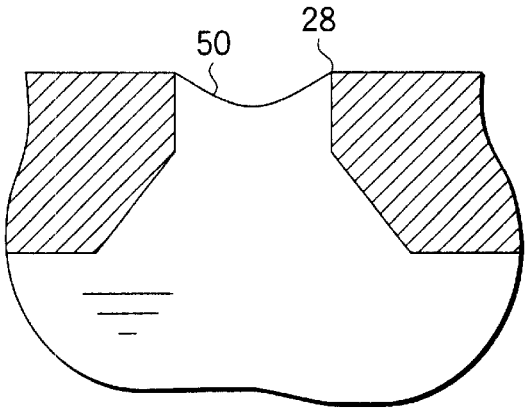

FIG. 6 is a sectional diagram showing a recording head 10*a* used in a third embodiment of the invention.

The recording head 10*a* attached with a piezoelectric vibrator of a flexural vibration mode is used as the aforesaid recording head 10*a*. The recording head 10*a* includes an actuator unit 51 in which a plurality of pressure chambers 52 are formed; a channel unit 55 in which nozzle orifices 53 and ink reservoirs 54 are formed and which is pasted on the lower face of the actuator unit 51; and piezoelectric vibrators 17 pasted on the upper face of the actuator unit 51. The recording head is arranged in a manner that pressure is generated within the pressure chamber 52 by actuating the piezoelectric vibrator 17 thereby to eject an ink droplet from the nozzle orifice 53.

The actuator unit 51 is formed by a plate 60 in which hollowed spaces for forming the pressure chambers 52 are formed, a vibration plate 61 positioned on the upper face of the chamber forming substrate 60 so as to cover the openings of the upper faces of the spaces, and a lid member 64 positioned on the lower face of the chamber forming substrate 60. The lid member 64 is provided with a first ink channel 62 for communicating the chamber 64 with the pressure chamber 52 and a second ink channel 63 for communicating the pressure chamber 52 with the nozzle orifice 53.

The channel unit 55 is configured by a reservoir forming substrate 66 in which hollowed spaces for forming the ink reservoirs 54 are provided, a nozzle plate 67 positioned on the lower face of the reservoir forming substrate 66, and a supply port forming plate 68 positioned on the upper face of the reservoir forming substrate 66. Nozzle communicating ports 59 communicating with the nozzle orifices 53 are formed at the reservoir forming substrate 66. The supply port forming plate 68 is perforated to form ink supply ports 65 each supplying the ink to the pressure chamber 52 through the first ink channel 62 from the ink reservoir 54 and is provided with communicating ports 58 each for communicating the pressure chamber 52 and the second ink channel 63 with the nozzle communicating port 59 and the nozzle orifice 53.

The piezoelectric vibrator 17 is formed in a plate shape at a portion on the vibration plate 61 corresponding to the pressure chamber 52. A lower electrode 69 is formed on the lower face of the piezoelectric vibrator 17 and an upper electrode 70 is formed on the upper face thereof so as to cover the piezoelectric vibrator 17. Terminals 71 electrically coupled to the electrodes 70 of the respective piezoelectric vibrators 17 are formed at the both end portions of the upper face of the actuator unit 51. Each of the terminals 71 is formed in a manner that the upper face thereof is higher than the upper face of the piezoelectric vibrator 17. A flexible circuit board 72 is provided in an extended manner on the upper faces of the terminals 71 so that the drive signal is inputted to the piezoelectric vibrators 17 through the terminals 71 and the electrodes 70. Although the figure shows only two pressure chambers 52, two piezoelectric vibrators 17 and two terminals 71, in fact, many of these elements are arranged in a direction orthogonal to the drawing.

In the recording head, when the driving waveform is inputted to the piezoelectric vibrator 17 to charge the piezoelectric vibrator 17, the piezoelectric vibrator 17 contracts in a direction perpendicular to the electric field. At this time, the lower side of the piezoelectric vibrator 17 fixed to the vibration plate 61 does not contract and only the upper side thereof contracts, so that both the piezoelectric vibrator 17 and the vibration plate 61 bend downward thereby to contract the pressure chamber 52. Then, due to the increase of the pressure within the pressure chamber 52, the ink within the pressure chamber 52 is ejected as an ink droplet 73 from the nozzle orifice 53 and an image is printed on a recording sheet or the like. Thereafter, when the piezoelectric vibrator 17 is ejected, both the piezoelectric vibrator 17 and the vibration plate 61 are restored to an original state, so that the pressure chamber 52 expands and new ink is supplied to the pressure chamber 52 through the ink supply port 65 from the ink reservoir 54.

In this manner, in the recording head 10*a,* the relation between the voltage level caused by the charging and ejecting of the piezoelectric vibrator 17 and the direction in which the pressure chamber 52 expands and contracts is completely in opposite to the first and second embodiments. The recording head 10*a* uses the drive signal which waveform is quite in opposite to that of the drive signals shown in the aforesaid embodiments. That is, each of the first and second embodiments uses such a drive signal which waveform is arranged to expand the pressure chamber 31 by rising the voltage and eject an ink droplet by lowering the voltage. In contrast, the recording head 10*a* uses the drive signal which waveform is arranged to expand the pressure chamber 52 by lowering the voltage and contract the pressure chamber 52 by rising the voltage. In this case, the function and effects similar to those of the aforesaid embodiments can be attained.

Numeral examples will be shown below.

Measurement has been made as to the driving voltage and the ink droplet speed at the time of ejecting an ink droplet of the same weight (2.5 ng) in each of the recording apparatus of the invention and a related example. The measurement result is shown in the following Table 1. As is clear from the table, it will be understood that the example can attain the ink droplet speed higher than that of the related example.

TABLE 1

| | embodiment | related example |
|---|---|---|
| ink weight (ng) | 2.5 | 2.5 |
| driving voltage (V) | 22 | 21.7 |
| ejection speed (m/s) | 7 | 4.5 |

Then, the stability of the ink droplet speeds Vm and the stability of the ejecting conditions was evaluated in the case where the ratio of the voltage difference V1 of the contraction waveform component P1 with respect to the voltage difference V0 of the preparation waveform component P3 is changed in each of room temperature, low temperature and high temperature. The result of the evaluation is shown in the following Table 2. Here, the stability of the ejecting conditions was affirmed by confirming whether dot omission and dot deviation are present or not.

TABLE 2

| voltage | room temp. | | low temp. | | high temp. | | | | |
|---|---|---|---|---|---|---|---|---|---|
| ratio | Vm | | Vm | | Vm | | evaluation | | |
| (%) | (m/s) | stability | (m/s) | stability | (m/s) | stability | A | B | C |
| 0 | 5.1 | ○ | 5.5 | ○ | 7.8 | ○ | | ○ | |
| 5 | 5.8 | ○ | 5.8 | ○ | 7.8 | ○ | | ○ | |
| 10 | 7.3 | ○ | 601 | ○ | 8.3 | ○ | ○ | ○ | ○ |
| 15 | 7.7 | ○ | 6.3 | ○ | 8.5 | ○ | ○ | ○ | ○ |
| 20 | 7.8 | ○ | 6.2 | ○ | 8.6 | ○ | ○ | ○ | ○ |
| 25 | 7.5 | ○ | 6.4 | ○ | — | x | ○ | ○ | ○ |
| 30 | — | x | 6.5 | ○ | — | x | ○ | ○ | ○ |
| 35 | — | x | 6.3 | ○ | — | x | ○ | ○ | ○ |
| 40 | — | x | 6.3 | ○ | — | x | ○ | ○ | ○ |
| 45 | — | x | 6.4 | ○ | — | x | ○ | ○ | ○ |
| 50 | — | x | 6.3 | ○ | — | x | ○ | ○ | ○ |
| 55 | — | x | — | x | — | x | | | |
| 60 | — | x | — | x | — | x | | | |

A ejecting condition
B ejecting stability
C total evaluation

As clear from the Table 2, in each of the circumstantial conditions of the room temperature, the low temperature and the high temperature, when the ratio of the voltage difference V1 with respect to the voltage difference V0 is lower than 10%, the ink droplet speed Vm was lowered. In contrast, it will be clear that when the ratio of the voltage difference V1 with respect to the voltage difference V0 exceeds 50%, the stability of the ejecting operation was degraded. Thus, the usable range of the ratio of the voltage difference V1 with respect to the voltage difference V0 is from 10% or more to 50% or less in view of the ejecting conditions and the usable range is 50% or less in view of the stability. Accordingly, the usable range of the ratio of the voltage difference V1 was from 10% or more to 50% or less in view of the total evaluation.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, the pressure generating element for varying the capacity of the pressure chamber is not limited to the piezoelectric vibrator. In short, as long as a pressure generating element is enabled to cause the pressure fluctuation of ink contained in the pressure chamber, the invention can be applied to the apparatus using such pressure generating elements. The invention can be applied to a recording head using a magnetostrictive element that is a kind of an electromechanical transducer.

What is claimed is:

1. An ink jet recording apparatus, comprising:

a recording head, provided with a pressure chamber communicated with a nozzle orifice from which an ink droplet is ejected, and a vibration plate which constitutes a part of the pressure chamber;

a pressure generating element, which deforms the vibration plate to vary a volume of the pressure chamber; and a drive signal generator, which generates a drive signal for driving the pressure generating element, the drive signal including:

a first waveform component, which drives the pressure generating element so as to contract the pressure chamber, to push out a meniscus of ink from the nozzle orifice such an extent that an ink drop is not ejected therefrom;

a second waveform component, which follows the first waveform component and drives the pressure generating element so as to expand the pressure chamber to a first volume, to pull the meniscus toward the pressure chamber;

a third waveform component, which follows the second waveform component and drives the pressure generating element so as to contract the pressure chamber from the first volume to a second volume which is larger than an initial volume of the pressure chamber, and hold the contracted state to eject an ink droplet from the nozzle orifice; and a fourth waveform component, which follows the third waveform component and drives the pressure generating element so as to contract the pressure chamber such an extent that an ink droplet is not ejected from the nozzle orifice.

2. The recording apparatus as set forth in claim 1, wherein a potential of an initial end of the first waveform component is higher than a lowest potential of the drive signal, and has a positive value.

3. The recording apparatus as set forth in claim 2, wherein the drive signal includes a fifth waveform component which follows the fourth waveform component and restores a potential of a termination end of the fourth waveform component to a potential which is identical with the initial end potential of the first waveform component.

4. The recording apparatus as set forth in claim 3, wherein a time period from a termination end of the fourth waveform component to a termination end of the fifth waveform component is identical with a time period obtained by multiplying a natural vibration period of the pressure chamber by an integer.

5. The recording apparatus as set forth in claim 1, wherein a potential of a termination end of the fourth waveform component and a potential of an initial end of the second waveform component are identical.

6. The recording apparatus as set forth in claim 5, wherein the drive signal includes a fifth waveform component which follows the fourth waveform component and restores the termination end potential of the fourth waveform component to a potential which is identical with a potential of an initial end of the first waveform component.

7. The recording apparatus as set forth in claim 6, wherein a time period from a termination end of the fourth waveform component to a termination end of the fifth waveform component is identical with a time period obtained by multiplying a natural vibration period of the pressure chamber by an integer.

8. The recording apparatus as set forth in claim 1, wherein a time period from an initial end of the first waveform component to an initial end of the second waveform component is identical with a time period obtained by multiplying a natural vibration period of the pressure chamber by an integer.

9. The recording apparatus as set forth in claim 1, wherein a time period from an initial end of the first waveform component to an initial end of the second waveform component is identical with a time period obtained by multiplying a natural vibration period of the vibration plate by an integer.

10. The recording apparatus as set forth in claim 1, wherein a potential gradient of the first waveform component is variable in accordance with an environmental condition of the recording apparatus.

11. The recording apparatus as set forth in claim 1, wherein a potential difference between an initial end and a termination end of the first waveform component is 10% to 50% of a potential difference between an initial end and a termination end of the second waveform component.

12. The recording apparatus as set forth in claim 1, wherein the drive signal generator repetitively generates the drive signal at a predetermined times within a unit printing period.

13. The recording apparatus as set forth in claim 1, wherein at least one of the drive signals are selectively applied to the pressure generating element to form a single ink dot by at least one ink droplet.

14. The recording apparatus as set forth in claim 1, wherein the pressure generating element is an electromechanical transducer.

15. The recording apparatus as set forth in claim 14, wherein the electromechanical transducer is a piezoelectric vibrator.

16. The recording apparatus as set forth in claim 1, wherein the second waveform component drives the pressure generating element to pull the meniscus when an ink pressure in an ejecting direction of the ink generated by the first waveform still remains.

17. A method of driving an ink let recording head provided with a pressure chamber communicated with a nozzle orifice from which an ink droplet is ejected, and a vibration plate which constitutes a part of the pressure chamber, comprising the steps of:

a) contracting the pressure chamber from a first volume to a second volume so as to push out a meniscus of ink from the nozzle orifice such an extent that an ink drop is not ejected therefrom, and holding the contracted state;

b) expanding the pressure chamber from the second volume to a third volume so as to pull the pushed-out meniscus toward the pressure chamber;

c) contracting the pressure chamber from the third volume to a fourth volume, and holding the contracted state to eject an ink droplet from the nozzle orifice; and d) contracting the pressure chamber from the fourth volume to a fifth volume such an extent that an ink droplet is not ejected from the nozzle orifice.

18. The driving method as set forth in claim 17, wherein the second volume and the fifth volume are identical.

19. The driving method as set forth in claim 17, further comprising the step of:

e) expanding the pressure chamber from the fifth volume to the first volume.

20. The driving method as set forth in claim 19, wherein a duration of the step e) is identical with a time period obtained by multiplying a natural vibration period of the pressure chamber by an integer.

21. The driving method as set forth in claim 19, further comprising the step of determining how many times the steps a)–e) are repeated within a unit printing period.

22. The driving method as set forth in claim 21, wherein the repeated number is determined in accordance with a size of ink dot to be formed.

23. The driving method as set forth in claim 17, wherein a duration of the step a) is identical with a time period obtained by multiplying a natural vibration period of the pressure chamber by an integer.

24. The driving method as set forth in claim 17, wherein a duration of the step a) is identical with a time period obtained by multiplying a natural vibration period of the vibration plate by an integer.

25. The driving method as set forth in claim 17, wherein a volume difference between the first volume and the second volume, and a duration of the step a) are determined in accordance with an environmental condition of the recording head.

26. The driving method as set forth in claim 17, wherein a volume difference between the first volume and the second volume is 10% to 50% of a volume difference between the second volume and the third volume.

* * * * *